US005662862A

United States Patent [19]

Braud et al.

[11] Patent Number: 5,662,862

[45] Date of Patent: Sep. 2, 1997

[54] DEVICE FOR GUIDING MOLTEN STEEL IN A TUNDISH

[75] Inventors: Yves Braud, Maurepas; Jean-Paul Hertault, Neufchatel-Hardelot, both of France

[73] Assignee: Societe des Terres Refractaires du Boulonnais, Neufchatel-Hardelot, France

[21] Appl. No.: 583,022

[22] PCT Filed: May 24, 1995

[86] PCT No.: PCT/FR95/00679

§ 371 Date: May 31, 1996

§ 102(e) Date: May 31, 1996

[87] PCT Pub. No.: WO95/32069

PCT Pub. Date: Nov. 30, 1995

[30] Foreign Application Priority Data

May 24, 1994 [FR] France ..... 94 06279

[51] Int. Cl.[6] ..... B22D 41/15

[52] U.S. Cl. ..... 266/229; 266/236; 266/275; 222/593; 222/594

[58] Field of Search ..... 266/236, 275, 266/229, 230; 222/592, 593, 594, 590

[56] References Cited

U.S. PATENT DOCUMENTS

| | | | |
|---|---|---|---|
| 5,397,105 | 3/1995 | Soofi | 266/236 |
| 5,494,266 | 2/1996 | Engelmann et al. | 266/275 |
| 5,518,153 | 5/1996 | Zacharis et al. | 222/594 |
| 5,551,672 | 9/1996 | Schmidt | 266/229 |

*Primary Examiner*—Scott Kastler
*Attorney, Agent, or Firm*—Pollock, Vande Sande & Priddy

[57] ABSTRACT

A device is located between the outlet zone and the distribution zone of a tundish that is provided with a reheat system, such as a plasma torch, at one side of a heading chamber. The device includes a refractory unit pierced by at least a first conduit having the shape of a truncated cone curved towards the predefined zone of the heating chamber and preferably flared at this zone, so as to ensure that liquid steel flow coming from the outlet zone is guided unidirectionally towards the predefined zone of the heating chamber.

8 Claims, 3 Drawing Sheets

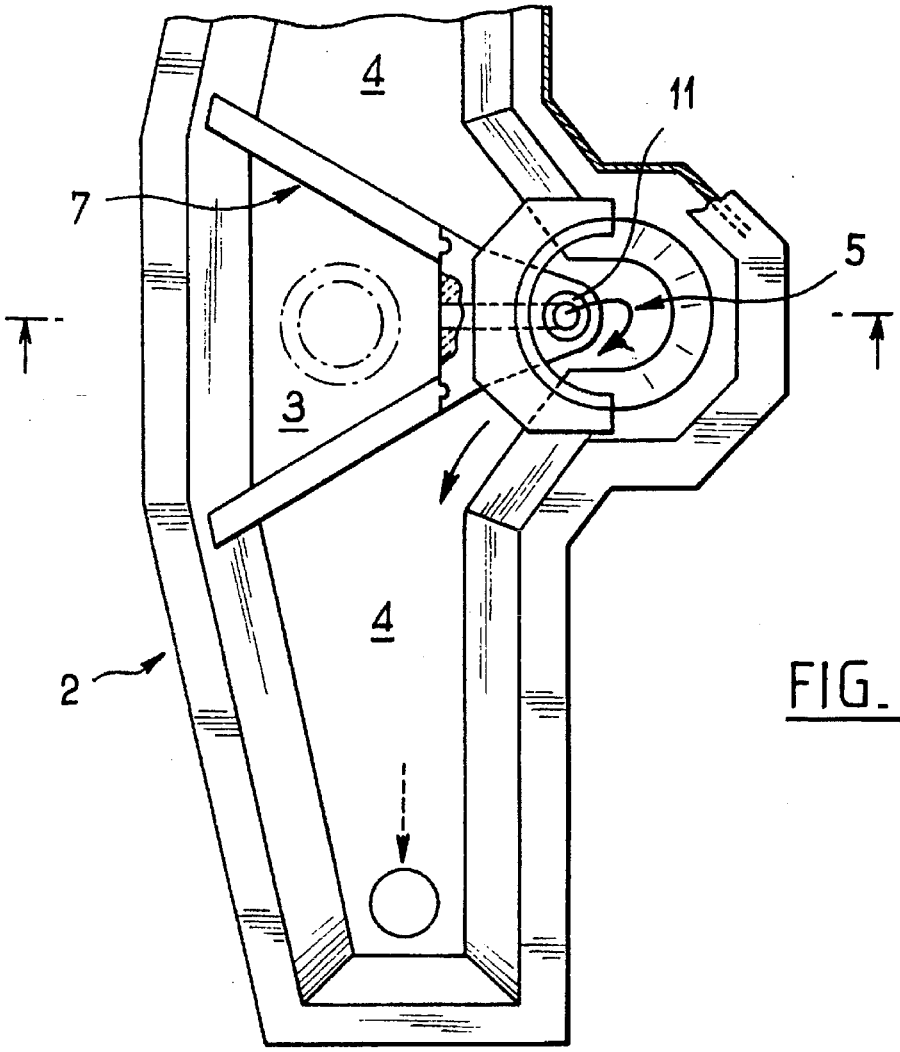
FIG. 3
FIG. 4
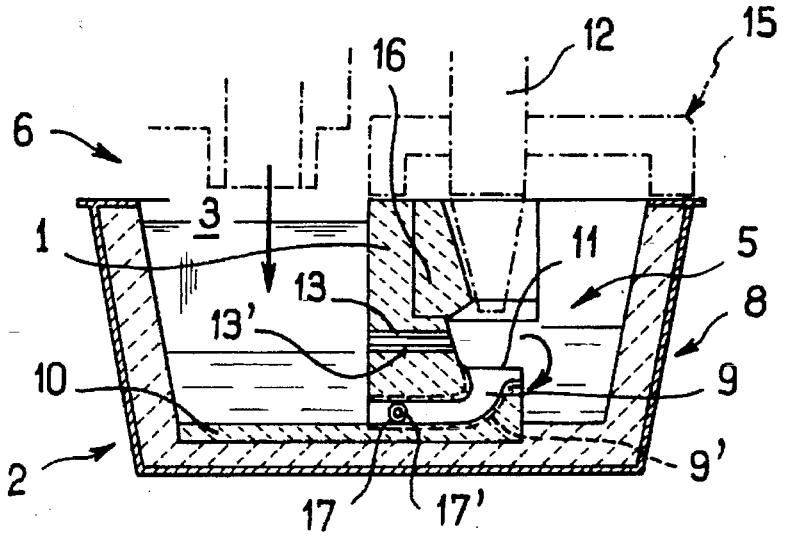

DEVICE FOR GUIDING MOLTEN STEEL IN A TUNDISH

FIELD OF THE INVENTION

The present invention relates to a device allowing continuous manufacture of metallurgical products from the solidification of a cast stream of steel coming from the pouring ladle.

BACKGROUND OF THE INVENTION

It relates more particularly to improvements made to continuous-casting tundishes. These enclosures are metallurgical vessels coated with refractory materials enabling the liquid steel to be settled and then directed towards the continuous-casting moulds. Thus, conventional tundishes comprise an outlet zone bounded by dams, into which outlet zone the liquid steel is poured from a ladle. On each side of this outlet zone, the vessel includes a drain enabling the tundish to be drained towards the continuous-casting moulds. The dams act as a syphon so that the liquid steel is settled.

The continuous-casting mould is the place where steel passes from the liquid state to the solid state in the form of slabs, blooms or billets. The temperature at which the liquid steel enters the continuous-casting mould must be accurately regulated so that the liquid steel does not freeze either too soon or too late. This temperature depends on the treatments to which the liquid steel has been subjected upstream of the tundish; it has therefore hitherto been difficult to control.

Tundishes equipped with a plasma torch are thus known, this torch being designed to reheat the liquid steel in the tundish. Thus the purpose of the plasma heating is to increase and regulate the temperature of the liquid steel leaving the ladle, which, by mixing action, results in the temperature of the liquid steel in the tundish being maintained within a narrow and controlled band.

This type of tundish, therefore, comprises a heating chamber between the outlet zone and the distribution zone of the tundish. The heating chamber is separated from the outlet zone by means of dams so as, inter alia, to prevent the slag from passing through, which would limit the efficiency of the operation. The heating chamber is covered by a dome in order to prevent air ingress and reduce heat losses and oxidation of the liquid steel.

Furthermore, the liquid-steel outflow system, between the ladle-draining zone (outlet zone) and the plasma heating chamber, must be conducive to flow rates of the liquid steel which are sufficient to orient it under the impact of the arc of the plasma torch and must ensure effective stirring of the liquid-steel pool.

Tundishes not provided with a molten-steel reheat system do not produce steel in the continuous-casting mould at the desired solidification temperature, and for tundishes equipped with a reheating means consisting of a plasma torch the major drawback lies in the fact that the impact of the arc of the plasma torch is very localized at the surface of the steel pool, as is therefore the zone reheated by the arc. It is therefore important that the stream of steel coming from the outlet zone be directed precisely beneath the arc. Hitherto, the stream has been directed towards the arc by a plane dam which is inclined to a greater or lesser extent. These tundishes do not enable the stream to be directed as accurately as desired.

BRIEF DESCRIPTION OF THE INVENTION

The present invention therefore aims to alleviate these drawbacks by providing a device for guiding molten liquid steel towards the zone swept by the arc of a plasma torch, enabling the temperature of the liquid-steel pool in the tundish to be maintained and regulated within a narrow and controlled band.

For this purpose, the guiding device, located between the outlet zone and the distribution zone of a tundish provided with a reheat system, especially a plasma torch, and constituting one side of the heating chamber, is characterized in that it includes a refractory unit pierced by at least one conduit having the shape of a truncated cone bent round towards the predefined zone of the heating chamber and possibly flared at this zone, so as to ensure that the liquid-steel flow coming from the outlet zone is guided unidirectionally towards the predefined zone of the heating chamber.

BRIEF DESCRIPTION OF THE DRAWINGS

Other characteristics and advantages of the present invention will emerge from the description given hereinbelow, with reference to the appended drawings which illustrate an embodiment thereof which is devoid of any limiting character. In the figures:

FIG. 3 is a cross-sectional plan view of the guiding device;

FIG. 4 is a cross-sectional side elevation view of the guiding device taken along section line 4—4;

DETAILED DESCRIPTION OF THE INVENTION

Figure 1:
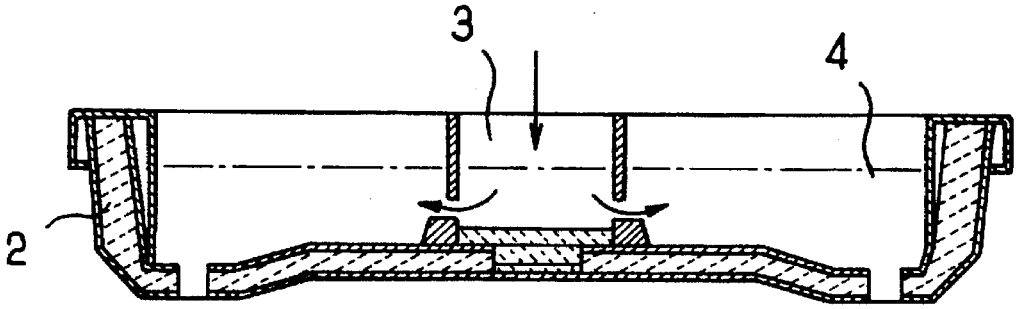
FIG. 1 is a cross-sectional front elevation view of a tundish according to the prior art.
Figure 2:
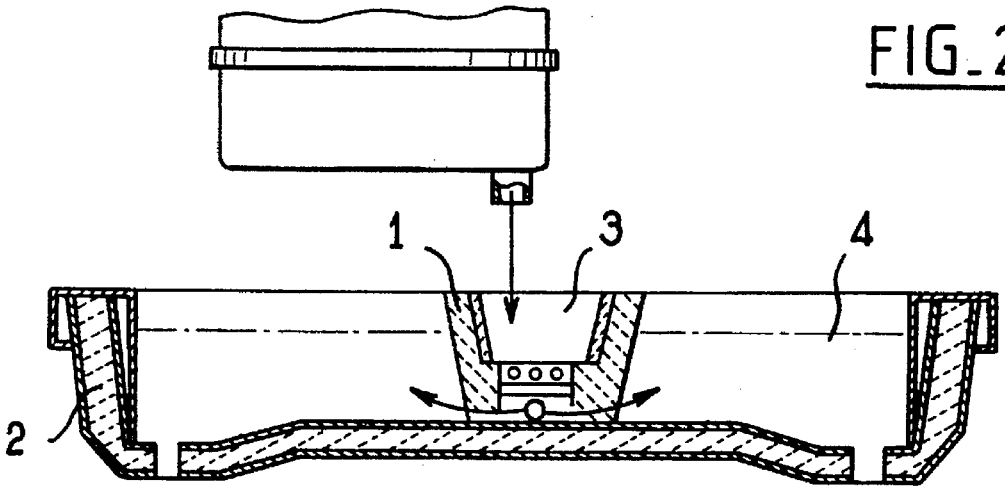
FIG. 2 is a cross-sectional front elevation view of a tundish provided with a guiding device according to the invention.
Figure 5:
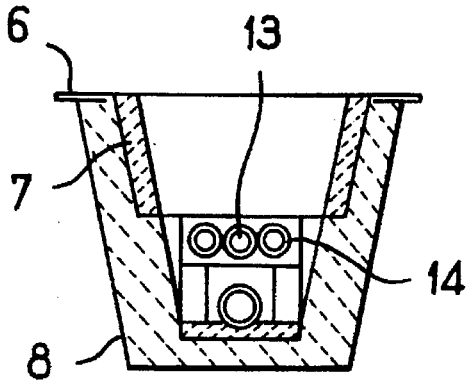
FIG. 5 is a cross-sectional front elevation view of a guiding device according to another embodiment.
Figure 6:
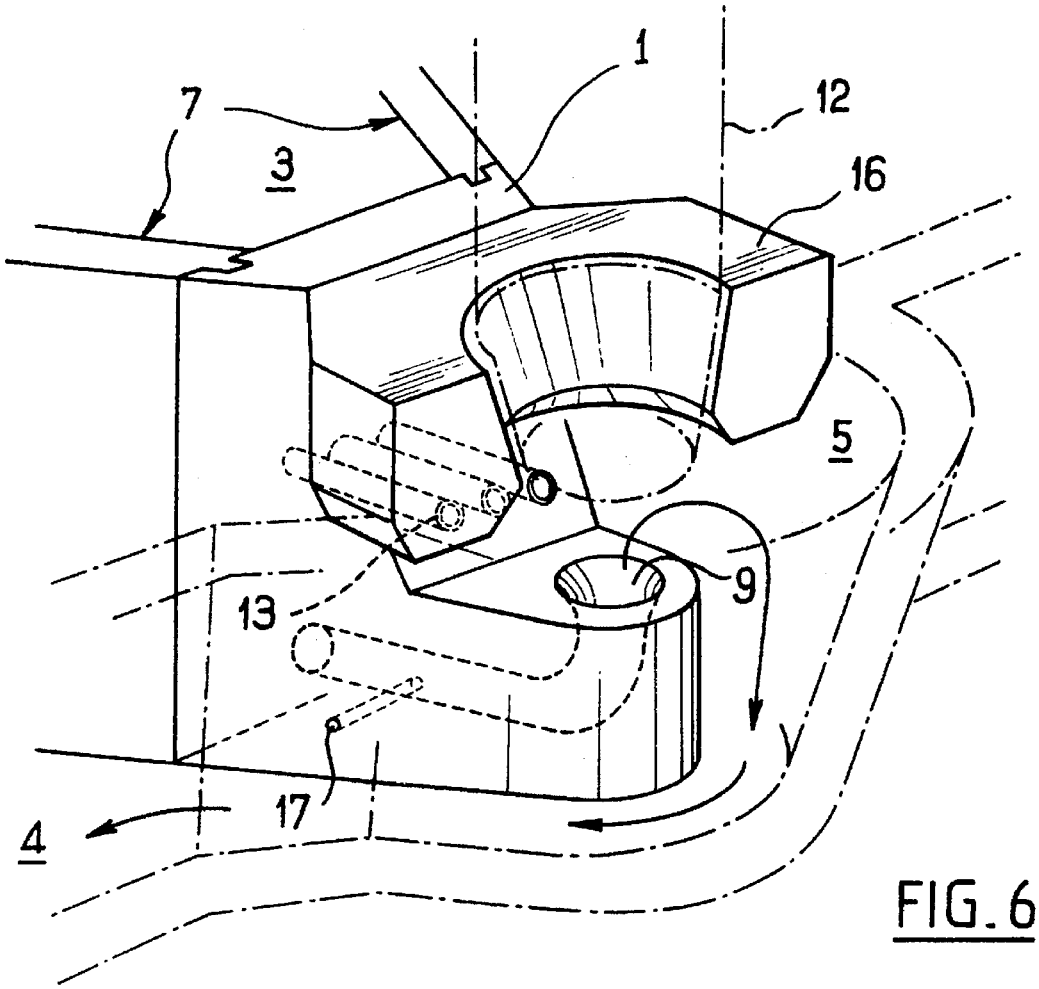
FIG. 6 is a perspective view of the guiding device according to the invention.
Figure 7:
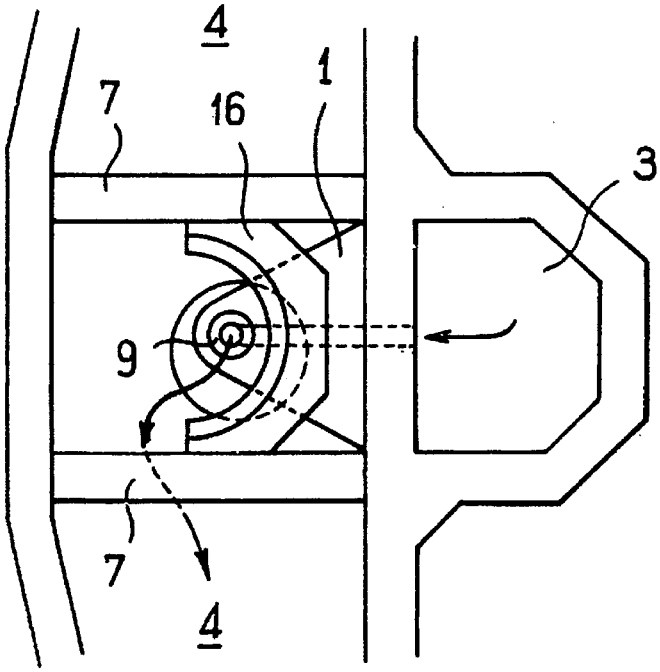
FIG. 7 is a cross-sectional plan view of another embodiment of the guiding device forming the subject of the invention.

According to a preferred embodiment, the guiding device according to the invention includes a dam unit 1, placed within a tundish 2 between an outlet zone 3 and a distribution zone 4, forming a third zone called the heating zone 5. This possibly monolithic dam unit 1, produced in an abrasion-resistant refractory material, comprises three zones: on the one hand, a lateral zone 6, similar to the outlet zone 3 of a conventional tundish 2, this zone being delimited by notably inclined dam-forming walls 7 and, on the other hand, in its lower part 8, a conduit 9 for the liquid steel coming from the outlet zone 3 to flow out towards the distribution zone 4, passing through a heating chamber 5 communicating with the said distribution zone 4. A plate 16, also made of refractory material, is arranged on the upper part of the dam unit 1, facing the said outflow conduit 9, this dam-forming plate substantially lying in a horizontal direction and delimiting the heating chamber 5, so as to allow the liquid steel to flow out towards the distribution zone 4.

At least one molten-steel outflow conduit 9 passes through the lower part 8 of the dam unit 1, this conduit extending between the outlet zone 3 and the heating chamber 5. This conduit 9 firstly travels along the base part of the dam unit 1, in a direction substantially coplanar with the wall 10 constituting the bottom of the tundish 2, and then forms an elbow oriented perpendicularly in the vertical plane, which emerges at the upper part, in an especially bellmouth-shaped flared zone 11, in the heating chamber 5. This outflow conduit 9 thereby constitutes a U-tube portion which allows liquid to flow between the outlet zone 3 and the heating chamber 5 by means of the conventional principle of communicating vessels.

By virtue of its geometry, the flared end zone 11 of the conduit 9 controls the rate of ejection of the stream of molten steel according to the desired velocity profile in order to obtain hydrodynamic stirring, allowing homogeneous mixing of steel in the heating chamber 5.

The steel passes from the outlet zone 3 to the distribution zone 4 via the ejection conduit 9 emerging in the heating chamber 5; in this latter zone, its free surface rises in temperature by means of a heater 12 placed facing this free surface, generally above it, and fixed by known means to the dam unit 1 level with the said plate 16. In the application intended by the invention, this heater 12 consists of a plasma torch whose arc is directed and focused above the entire surface area formed by the flared end zone 11 of the stream-ejection conduit 9, thus avoiding inappropriate steel residence times in the heating chamber 5.

Having been reheated, the steel at the surface in the heating chamber 5 flows out, due to the stirring, laterally towards the distribution zone.

According to another characteristic of the invention, a plurality of conduits 13 pass radially right through the dam unit i between the outlet zone 3 and the heating chamber 5, these conduits 13 extending in a direction substantially parallel to the plane surface defined by the upper part of the flared end zone 11 of the conduit 9 for ejecting the steel stream towards the outlet zone 3; these conduits 13 form zones for relieving the thermomechanical stresses which occur within the dam unit 1 when filling up the outlet zone.

According to another characteristic of the invention, the refractory dam unit 1 includes at least one lateral conduit 17 emerging in each distribution zone 4 and in the lower part of the outflow conduit 9, so as to ensure that the outlet zone 3 is completely drained at the end of casting.

According to another embodiment of these conduits 9, 13 or 17, they are no longer obtained immediately from the moulding of the monolithic dam unit 1 but are composed of inserts 9', 13', 17', also produced in a refractory material, possibly having physico-chemical properties different from the material forming the dam unit and advantageously, a material possessing high abrasion resistance characteristics.

The heating chamber 5 is covered by a dome-shaped screen 15 enabling, on the one hand, unwanted ingress of air and therefore sources of oxidation of the steel pool, to be limited as much as possible and enabling, on the other hand, a protective screen to be formed so as to reduce heat losses.

According to another embodiment of the guiding device forming the subject of the invention, the dam unit 1 is placed between an outlet zone 3 and a distribution zone 4. By means of its front wall, forming a main dam, the dam unit 1 delimits the separation between these two zones, which zones communicate via the outflow conduit 9. The side walls 7 of this dam unit 1 also form secondary dam zones inside the distribution zone 4.

In fact, the height of the side walls 7 arranged within this distribution zone 4 is less than the overall height of the dam unit 1. In their lower part, these side walls 7 thus delimit a zone for the metal coming from the heating chamber 5 to pass towards the distribution zones 4 adjacent to these walls 7.

The invention as described hereinabove has many advantages, including especially:

- the molten-steel outflow system between the outlet zone and the heating chamber is conducive to obtaining flow rates of the liquid steel which are sufficient to orient it correctly under the impact of the arc of the plasma torch;
- the dam unit bounding a heating chamber between the outlet zone and the distribution zone improves, on the one hand,
- the reheating of the steel coming from the pouring ladle and, on the other hand,
- the conveying of the reheated steel towards the continuous-casting streams, while at the same time limiting oxidation phenomena as much as possible.

Of course, it remains the case that the present invention is not limited to the embodiments described and represented hereinabove, but that it encompasses any variant thereof.

We claim:

1. A molten metal guiding device, located between an outlet zone and a distribution zone of a tundish provided with a reheat system, including a plasma torch located at one side of a heating chamber, the device comprising a refractory unit pierced by at least a first conduit having the shape of a truncated cone curved towards a predefined zone of the heating chamber and flared at this zone, to ensure that a liquid-steel flow coming from the outlet zone is guided unidirectionally towards the predefined zone of the heating chamber.

2. A device according to claim 1, characterized in that the refractory unit is monolithic.

3. A device according to one of claim 1, wherein the conduit comprises an insert manufactured from a material different from the refractory unit.

4. A device according to claim 1, wherein the refractory unit includes at least one lateral second conduit emerging in the distribution zone and focusing through the lower part of the first conduit, so as to ensure that the outlet zone is completely drained at the end of casting.

5. A device according to claim 4, wherein the conduit comprising an insert manufactured from a material different from the refractory unit.

6. A device according to claim 1, the device further includes at least one horizontal third conduit which is located above the first conduit between the outlet zone and the heating chamber and acts as a relieving conduit for relief of thermomechanical stresses.

7. Device according to claim 6, wherein the conduit consists of an insert manufactured from a material different from the refractory unit.

8. A device according to claim 1, wherein the refractory unit has a front wall, forming a main dam, between the distribution zone and the outlet zone, and side walls, forming secondary dams, enabling the molten metal to pass below the dams between the heating chamber and the distribution zone.

* * * * *